US007370481B2

(12) United States Patent
Kawamura et al.

(10) Patent No.: US 7,370,481 B2
(45) **Date of Patent: *May 13, 2008**

(54) APPARATUS AND METHOD FOR COOLING SUPER CONDUCTIVE BODY

(75) Inventors: Kuniaki Kawamura, Tokyo (JP); Akito Machida, Tokyo (JP); Masamitsu Ikeuchi, Tokyo (JP); Kazuhiro Hattori, Tokyo (JP); Kouichi Matsuo, Tokyo (JP); Hideharu Yanagi, Tokyo (JP)

(73) Assignee: Mayekawa Mfg. Co., Ltd. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/532,527

(22) Filed: Sep. 16, 2006

(65) Prior Publication Data

US 2007/0006599 A1 Jan. 11, 2007

Related U.S. Application Data

(60) Division of application No. 11/165,528, filed on Jun. 23, 2005, now Pat. No. 7,155,930, which is a continuation of application No. PCT/JP2004/000809, filed on Jan. 29, 2004.

(30) Foreign Application Priority Data

Mar. 11, 2003 (JP) ..... 2003-065571
Nov. 20, 2003 (JP) ..... 2003-391508

(51) Int. Cl.
*F17C 5/00* (2006.01)
*F25D 23/12* (2006.01)
*H01B 12/00* (2006.01)
*H01F 6/06* (2006.01)

(52) U.S. Cl. ..... 62/54.1; 62/259.2; 174/125.1; 505/163

(58) Field of Classification Search ..... 62/54.1, 62/259.2; 174/125.1; 505/163
See application file for complete search history.

(56) References Cited

U.S. PATENT DOCUMENTS 3,643,002 A * 2/1972 Minnich ..... 174/15.5

(Continued)

FOREIGN PATENT DOCUMENTS

JP 06-077541 A 3/1994

(Continued)

*Primary Examiner*—Williams C Doerrler
(74) *Attorney, Agent, or Firm*—Rossi, Kimms & McDowell LLP

(57) ABSTRACT

Liquid nitrogen is filled in a low temperature vessel; an ejector that sucks liquid nitrogen by blowing a cooling agent (liquid or gas) such as low temperature helium gas or liquid helium of pressure higher than in the space within the vessel is disposed in the vessel; the liquid nitrogen blown with the cooling agent is cooled by the cooling agent to become fine particles of solid nitrogen which fall down; and gas in a space of the vessel is discharged out of the vessel so as to maintain the pressure of the space higher than the atmospheric pressure. A gaseous phase of liquid nitrogen in an adiabatic vessel is depressurized to vaporize nitrogen in a liquid phase so that the temperature of the nitrogen reaches the triple point of nitrogen by lowering the temperature to thereby produce solid nitrogen by keeping the temperature at the triple point, and that the produced solid nitrogen is transformed into slush by stirring the content of the adiabatic vessel. A super conductive body formed of a material exhibiting a state of super conductance in the vicinity of the temperature of liquid nitrogen or of the temperature where liquid nitrogen and solid nitrogen coexist can be cooled by immersing the body in slush nitrogen held in an adiabatic vessel or flowing in an adiabatic pipe.

9 Claims, 7 Drawing Sheets

U.S. PATENT DOCUMENTS

| | | | | | |
|---|---|---|---|---|---|
| 3,994,141 | A | * | 11/1976 | Schrawer | 62/76 |
| 4,009,013 | A | | 2/1977 | Schrawer et al. | |
| 4,015,437 | A | * | 4/1977 | Daus | 62/76 |
| 4,237,507 | A | * | 12/1980 | Meierovich et al. | 361/19 |
| 4,295,346 | A | | 10/1981 | Hoffman | |
| 4,488,407 | A | | 12/1984 | Delano | |
| 4,796,432 | A | * | 1/1989 | Fixsen et al. | 62/51.1 |
| 5,154,062 | A | * | 10/1992 | Gaumer et al. | 62/54.1 |
| 5,168,710 | A | * | 12/1992 | Miyazaki | 62/54.1 |
| 5,402,649 | A | | 4/1995 | Glasser | |
| 5,724,831 | A | | 3/1998 | Reznikov et al. | |
| 6,405,541 | B1 | | 6/2002 | Brunnhofer | |
| 7,155,930 | B2 | * | 1/2007 | Kawamura et al. | 62/601 |
| 2006/0235375 | A1 | * | 10/2006 | Littrup et al. | 606/21 |

FOREIGN PATENT DOCUMENTS

| | | | |
|---|---|---|---|
| JP | 06-241647 | A | 9/1994 |
| JP | 06-281321 | A | 10/1994 |
| JP | 08-283001 | A | 10/1996 |
| JP | 08-285420 | A | 11/1996 |
| JP | 09-283321 | A | 10/1997 |
| JP | 2000-258053 | A | 9/2000 |
| JP | 2002-135917 | A | 5/2002 |

* cited by examiner

APPARATUS AND METHOD FOR COOLING SUPER CONDUCTIVE BODY

This is a divisional of application Ser. No. 11/165,528 filed 23 Jun. 2005, now U.S. Pat. No. 7,155,930 which is a continuation of International application No. PCT/JP2004/000809 having an International filing date of 29 Jan. 29, 2004.

BACKGROUND

1. Field of the Invention

The present invention relates to a method and an apparatus for producing slurry of a mixture of liquid nitrogen and solid nitrogen, which is slush nitrogen, and a simple method for evaluating solid concentration of the same and a method for cooling using the same.

2. Description of the Related Art

Liquid nitrogen is widely used as a cooling agent. When a sherbet-like mixture of solid nitrogen and liquid nitrogen is used, its density and cooling capacity per unit mass are increased so that the mixture becomes an efficient cooling agent. However, a method for producing economically slush nitrogen comprising solid nitrogen having a homogenous and fine particle size has not been established.

Slush nitrogen has an excellent capacity of absorbing heat load compared with liquid nitrogen because a latent heat of melting of solid nitrogen is used so that slush nitrogen is effectively used for cooling an electric-power-transmission cable for high-temperature super conductivity and high-temperature super conductive apparatuses such as a magnet, a current limiting device, and a transformer, etc. Meanwhile, taking advantage of its characteristics that its density and cooling capacity per unit mass are increased, a sherbet-like mixture of solid hydrogen and liquid hydrogen attracts attention as a future fuel for an aerospace plane and its production method and apparatus are developed.

As for production methods of slush hydrogen, there are (1) a spraying method, (2) a freezing-melting method, and (3) a helium freezing method. In a spray method (1), when a low temperature vessel (cryostat) is depressurized to under 50 mmHg and liquid hydrogen is sprayed into the vessel, liquid particles are deprived of a latent heat of vaporization so that the temperature is lowered and solid hydrogen particles are generated. In a freezing-melting method (2), when a low temperature vessel containing liquid hydrogen is depressurized with a vacuum pump, hydrogen is vaporized from the liquid surface of the liquid hydrogen to generate solid hydrogen on the surface of the liquid hydrogen by being deprived of a latent heat of vaporization. The solid hydrogen is crushed mechanically to obtain slush hydrogen. In a helium freezing method (3), liquid hydrogen is filled in a low temperature vessel in which a heat exchanger is disposed; a helium gas of a temperature below 18-13 K is introduced to solidify by cooling the liquid hydrogen on the heat exchanger. The solidified hydrogen is scraped mechanically to obtain slush hydrogen (See Japanese laid-open patent publication JP06-241647).

A method for producing slush hydrogen is disclosed on Japanese laid-open patent publication JP08-285420, where solid hydrogen is generated by blowing liquid hydrogen into a depressurized low temperature vessel and liquid hydrogen is introduced into the vessel and the contents are stirred with a stirrer provided to the vessel. Furthermore, Japanese laid-open patent publication JP08-283001 discloses the following method for producing slush hydrogen. When hydrogen gas is introduced from the bottom of a low temperature vessel into which liquid helium is filled, the hydrogen is cooled to solidify while the hydrogen ascends in the liquid helium. Though the liquid helium is vaporized, if introduction of hydrogen is continued while the vaporized helium is evacuated, the vessel is almost filled with solid hydrogen. Then, liquid hydrogen is filled in the vessel to produce slush hydrogen. By this method, the internal of the vessel can be kept at the pressure greater than the atmospheric pressure so that air does not intrude in from the outward and the solid hydrogen particles in the obtained slush hydrogen are homogenously fine on account of abrupt cooling by liquid helium.

Japanese laid-open patent publication JP06-281321 discloses a method and an apparatus for producing slush hydrogen wherein liquid hydrogen is solidified on a cooled solid surface using cooling heat of liquid helium in the liquid hydrogen in a low temperature vessel (cryostat), whereby an abundant slush nitrogen is continuously produced by blowing over cooled liquid hydrogen in a low temperature vessel.

Though, in the above methods, slush nitrogen is obtained using liquid nitrogen instead of liquid hydrogen, each has the following problem. In the spray method (1), since liquid hydrogen (liquid nitrogen in case slush nitrogen is produced) is blown in the evacuated low temperature vessel, air might intrude into the vessel from the outside. In the freezing-melting method (2), air might intrude into the vessel from the outside because of depressurization of the inside of the low temperature vessel and besides; there is a drawback that particles of solid hydrogen are uneven and large. In the helium freezing method (3), particles of solid hydrogen are also uneven and large, and a particular heat exchanger is necessary.

In the case of JP08-285420, as liquid hydrogen is blown in the depressurized cooled vessel, air might intrude from the outside. Since a boiling point of liquid helium at the atmospheric pressure is 4.22 K and a melting point of solid hydrogen is 13.83 K, if a diameter of the blowing hole of a blowing nozzle immersed in liquid helium is made small in order to obtain fine particles of solid hydrogen with the method of JP08-283001, the blowing hole of the nozzle cooled below the melting point of solid hydrogen might be occluded with solid hydrogen. As a melting point of solid nitrogen is 63.17 K, which is far higher than that of solid hydrogen, if this method is applied for a production of solid nitrogen, the nozzle is occluded unless a diameter of the nozzle hole and a flow volume are large, resulting in that fine particles of solid nitrogen can not stably obtained.

Each aforementioned prior art aims at slush hydrogen production, and besides, a coolant (helium) other than object material is used. Even if the art is applied to production of slush nitrogen, an apparatus for liquefaction is necessary and a temperature has to be lower than that of nitrogen or hydrogen liquefaction when using helium that is already used as a cooling agent by recondensation thereof, whereby an apparatus becomes large and also production cost becomes high.

There has been no appropriate method for evaluating solid nitrogen concentration in slush nitrogen. If slush nitrogen flows, the concentration can be measured by a mass flow meter. As it cannot be measured unless it flows, a means for flowing is necessary. In addition, insulating device needs to be added for it is used under very low temperature, which results in high production cost. Furthermore, because nitrogen comes to be mixed in the apparatus for liquefying helium, long operation of the apparatus is difficult or an apparatus with a high performance is needed.

Meanwhile, as it is necessary to keep the temperature lower than a critical temperature of the material in order to activate a super conductive coil, a super conductive cable or others in a super-conductive state, it was conventionally cooled by immersing a body in liquid helium (b.p. 4.2 K) (for example, see JP06-77541, JP09-283321), whereas as research and development of super conductive material is advanced, a material having a high critical temperature has been found and utilized, a cooling temperature has become high. On account of emergence of high temperature super conductive material, liquid nitrogen (b.p. 77 K) can be used instead of costly liquid helium so that it has become extremely advantageous to put into practical use.

When liquid nitrogen is used to cool a super conductive apparatus by immersing in liquid nitrogen, a variety of ideas are made against bubble formation in liquid nitrogen by heat generation due to AC loss or heat intrusion from the outside, as it deteriorates insulation properties. For example, liquid nitrogen is cooled under the boiling point of liquid nitrogen to use, the boiling point is raised by pressurizing or both methods are joined. However, a temperature that cools liquid nitrogen of a melting point of 63 K without solidifying is limited to 65 K at best. An upper limit just before boiling is about 75 K. That means a temperature range capable of cooling by a sensible heat of liquid nitrogen is 10 degrees variation. Since a specific heat of liquid nitrogen is 2 kJ/kg, a heat capacity that a sensible heat of liquid nitrogen has per unit mass of liquid nitrogen is merely 20 kJ/kg. Further, as a matter of fact, it is usual that a performance of a cooled super conductor is stably higher at the temperature in the vicinity of a freezing point than in the vicinity of a boiling point of liquid nitrogen.

More specifically, as a temperature range capable of cooling with liquid nitrogen as a liquid state utilizing a sensible heat thereof is narrow and a heat capacity is small, a vast amount of liquid nitrogen is necessary for cooling (eliminating heat) so that a super conductive apparatus becomes large in size. If a cooling temperature rises to about a boiling point with this method, the performance of a super conductive device is limited to that temperature.

SUMMARY OF THE INVENTION

The present invention has been made in view of the problems that the aforementioned prior arts have. The object of the present invention is to provide a method and an apparatus for producing slush nitrogen, which is new and simple as for slush nitrogen, and a method for evaluating solid concentration of the same. Another object of the present invention is to provide a method for cooling effectively with a little cooling agent at a low temperature a super conductive body in which the super conductive material showing a super conductive state at a temperature of coexisting both solid and liquid nitrogen is used.

In order to solve the above problems, the inventor proposes the following present invention.

According to the present invention, a method for producing slush nitrogen is characterized in that liquid nitrogen is filled in a low temperature vessel, that an ejector that sucks liquid nitrogen by blowing a cooling agent (liquid or gas) such as low temperature helium gas or liquid helium of pressure higher than in the space within the vessel is disposed in the vessel, that the liquid nitrogen blown with the cooling agent is cooled by the cooling agent to become fine particles of solid nitrogen which fall down, and that gas in a space of the vessel is discharged out of the vessel so as to maintain the pressure of the space higher than the atmospheric pressure.

Thus, in an atmosphere of a gaseous cooling agent such as helium whose pressure is kept at a little higher than the atmospheric pressure, liquid nitrogen is sucked and is blown into an atmosphere of the gaseous cooling agent by an ejector in which liquid helium or low temperature gaseous helium is an working fluid thereof, whereby the blown liquid nitrogen is cooled to be solidified by colliding and mixing with a cooling liquid or gas of an working fluid in a diffuser part of the ejector or after coming out of the diffuser. Therefore, solid nitrogen having a small and even particle size is generated. The solid nitrogen falls down into the downward of the vessel by the gravitational forth on account of its higher specific gravity than the gas in the atmosphere and is mixed with the liquid nitrogen to produce slush nitrogen. In case a working fluid is cooling liquid, the cooling liquid is vaporized by depriving nitrogen of heat in the vessel. As a temperature of the liquid nitrogen filled in the downward of the vessel is higher than that of the atmosphere in the vessel, the liquid nitrogen is vaporized so that a gas in the atmosphere becomes a mixture gas of the cooling gas and the nitrogen gas, which is always discharged so as to keep the inward of the vessel a constant pressure greater than the atmospheric pressure. Hence, air is not intruded into the vessel. The mixture gas can be reused by separating into cooling agent and nitrogen. As a cooling agent, helium, hydrogen and neon can be used.

According to the present invention, a particle size of the solid nitrogen is controlled by varying a pressure for supplying the cooling agent to the ejector. When the pressure is made higher, a speed blowing from a nozzle of the ejector becomes greater so that particles of liquid nitrogen sucked become finer to produce solid nitrogen having a finer particle size. Further, variation of a diameter of the hole of a nozzle and its combination with the speed can control a wide range of particle size.

Further, it is preferable to heat the diffuser part of the ejector in order to prevent freezing to accrete solid nitrogen to the diffuser part of the ejector. Since a melting point of nitrogen at the atmospheric pressure is 63.17 K, which is extremely high compared with a boiling point of a cooling agent such as helium (Boiling points of helium, hydrogen and neon at the atmospheric pressure are 4.22K, 20.28K and 27.09K respectively.) so that frozen solid nitrogen is stuck to the diffuser part to narrow a passage of the diffuser and occlude it, the diffuser part is preferably heated depending on circumstances.

Further, solid nitrogen produced is preferably made to be fine particles by disposing two ejectors and by subjecting jet streams from the diffusers of the ejectors to collision with each other. Thus, solid nitrogen produced can be made fine particles finer than in case of a single jet stream by subjecting mixed jet streams of a cooling agent and liquid nitrogen from the diffusers of the ejectors to collision with each other.

Further, according to another aspect of the present invention, an apparatus for producing slush nitrogen comprising a low temperature vessel capable of filling liquid nitrogen therein, an ejector disposed in the vessel and a means for evacuating a space in the vessel, wherein a line for supplying working fluid of the ejector, the line leading to the outside of the vessel, is connected to a working fluid port of the ejector, a pipe for sucking liquid nitrogen which reaches the vicinity of the bottom of the vessel is connected to a suction fluid port of the ejector, and stored liquid nitrogen is sucked through the pipe for sucking liquid nitrogen to be blown with the cooling agent, is cooled to solidify and is caused to fall in the stored liquid nitrogen as fine particles of liquid nitrogen by supplying a cooling agent of liquid or gas such as liquid helium or low temperature helium gas having a pressure higher than that of the space in the vessel to the ejector through the line for supplying working fluid of the ejector and by blowing the same.

Further, according to the present invention, a means for adjusting pressure which varies a cooling agent supplying pressure to the ejector is provided at the side of the line for supplying working fluid of the ejector.

Further, according to the present invention, a means for heating for preventing freezing to accrete solid nitrogen to the diffuser part of the ejector is provided at the diffuser part of the ejector.

Further, according to the present invention, the solid nitrogen produced is made to be fine particles by disposing two ejectors and by subjecting jet streams from the diffusers of the ejectors to collision with each other.

Further, according to the present invention, a means for stirring for not inhibiting falling down of the frozen solid nitrogen on the surface of the stored liquid nitrogen into the stored liquid nitrogen is provided.

Further, according to the present invention, a means for stirring for preventing sedimentation of the solid nitrogen fallen into the stored liquid nitrogen so as to homogenize the mixture thereof.

According to the present invention, a method for producing slush nitrogen is characterized in that a gaseous phase of liquid nitrogen in the adiabatic vessel is depressurized to vaporize nitrogen in a liquid phase so that a temperature of the nitrogen is reached to the triple point of nitrogen by lowering temperature thereby and solid nitrogen is produced by keeping at the triple point, and that the produced solid nitrogen is transformed into slush by stirring the content of the adiabatic vessel.

Further, according to the present invention, a liquid surface part of the liquid nitrogen and a bottom part in the adiabatic vessel are stirred separately.

The liquid nitrogen in the adiabatic vessel is deprived of latent heat of vaporization (199.1 kJ/kg) to be solidified (a latent heat of solidification is 25.73 kJ/kg) on the surface of the liquid so that a thin skin of solid nitrogen grows. As the solid does not mix with the liquid, if it allows as it is, for example, a stirring blade is provided at the vicinity of the liquid surface to stir and give turbulence on the liquid surface so that the solidified nitrogen is broken and the solid nitrogen having a density grater than liquid nitrogen is caused to sink in the liquid. When the solid nitrogen sinks to renew the surface, further vaporization from the surface proceeds so as to produce solid nitrogen continuously.

The sunken solid nitrogen is admixed by a large stirring blade disposed at the bottom of the vessel. Large particles of the solid nitrogen collide repeatedly with each other to become fine particles and a slurry like fluid in which liquid and solid are homogenously mixed (transformation into slush).

According to yet another aspect of the present invention, an apparatus for producing slush nitrogen comprising an adiabatic vessel filled with liquid nitrogen, a means for depressurizing connected to the upper part of the vessel to depressurize the inner part of the vessel, a means for stirring capable of stirring the content of the adiabatic vessel, and a means for detecting temperature, is characterized in that the liquid nitrogen in the vessel is depressurized by the means for depressurizing to vaporize nitrogen so that a temperature of the nitrogen is reached to the triple point of nitrogen by lowering temperature thereby and solid nitrogen is produced, and that the produced solid nitrogen is transformed into slush by stirring the produced solid nitrogen by the stirring means.

Further according to the present invention, an apparatus for producing slush nitrogen comprising an adiabatic vessel filled with liquid nitrogen, a means for depressurizing connected to the upper part of the vessel to depressurize the inner part of the vessel, a means for stirring capable of stirring the content of the adiabatic vessel, a means for detecting temperature, and a window for visual observation, is characterized in that the liquid nitrogen in the vessel is depressurized by the means for depressurizing to vaporize nitrogen so that a temperature of the nitrogen is reached to the triple point of nitrogen by lowering temperature thereby and solid nitrogen is produced, and that the produced solid nitrogen is transformed into slush by stirring the produced solid nitrogen by the means for stirring.

Further according to the present invention, the means for stirring comprises a means for stirring a liquid surface of the liquid nitrogen and a means for stirring a bottom part of the adiabatic vessel.

According to yet another aspect of the present invention, a simple method for evaluating solid concentration of slush nitrogen is characterized in that when a solid concentration of slush nitrogen produced by the aforementioned method is evaluated, a volume of slush nitrogen at a time when the temperature reaches the triple point and a volume of slush nitrogen at a time when an operation ends are measured to find a solid concentration of slush nitrogen.

As a density of the liquid at the triple point is 868.4 $kg/m^3$ and that of the solid is 946 $kg/m^3$, a concentration of solid nitrogen after production of slush nitrogen is found if a volume of slush nitrogen at a time when the temperature reaches the triple point and a volume of slush nitrogen at a time when an operation ends are measured.

The volumes are most easily found by measured values and a cross sectional area of the vessel if a level gauge is disposed at the adiabatic vessel and a height of the level at the time is measured.

Further, according to the present invention, in a method for cooling a super conductive body formed of a material exhibiting a state of super conductance in the vicinity of the temperature of liquid nitrogen or of the temperature where liquid nitrogen and solid nitrogen coexist, slush nitrogen is flowed in an adiabatic pipe while the body is placed in the flowing slush nitrogen so that the body is in contact with slush nitrogen.

As slush nitrogen is a mixture of solid and liquid nitrogen, the mixture expresses a temperature of the vicinity of a melting point of solid nitrogen; and yet on account of its being fluid, slush nitrogen wets well a surface of a solid object so that the liquid penetrates in narrow gaps and shows good heat conductance; and further, a latent heat of melting of solid nitrogen 25 kJ/kg can be utilized for cooling. Hence, a cooling effect is higher than 12.5 times of a sensible heat of liquid nitrogen; and as long as solid nitrogen exists, a temperature of a cooling agent of slush nitrogen never rises over approximately 63 K so that an immersed superconductive body can be kept at low temperature.

Even after stopping to send the cooling agent of slush nitrogen, a superconductive body is kept at a low temperature for a while because of its latent heat of melting so that a reliability of the system is improved.

Further, according to the present invention, the super conductive body is immersed in slush nitrogen held in an adiabatic vessel while stirring the slush nitrogen. Because solid nitrogen is greater in specific gravity than liquid nitrogen, solid nitrogen in slush nitrogen tends to sink. Therefore, it is preferable to homogenize a particle concentration of slurry and also to bring about an effect of renewing forcibly a heat transfer membrane of a cooled body.

This method is effective for cooling a long body such as a superconductive cable and has a stirring effect caused by flowing so that the method has effects of preventing sedimentation of particles in slurry and of renewing forcibly a heat transfer membrane.

According to another aspect of the present invention, an apparatus for cooling the super conductive body an apparatus includes the adiabatic vessel for holding the slush nitrogen, with the vessel having an inlet and an outlet for immersing the body in the slush nitrogen.

In the case of this batch type cooling apparatus, an inlet hole capable of introducing new slush nitrogen having a high concentration of solid nitrogen and an outlet hole for drawing out slush nitrogen or liquid nitrogen whose concentration of solid nitrogen becomes low or null by giving a latent heat to the cooled body to be liquefied are further provided so that renewal of slurry or liquid in the vessel is possible at an appropriate time. Further, new slush nitrogen is introduced at a given rate and inner slush nitrogen is drawn out at the same rate to balance the concentration of the solid nitrogen so that a predetermined cooling effect can be continuously maintained.

Further, the cooling apparatus is connected to an apparatus for producing slush nitrogen. The drawn out slush nitrogen or liquid nitrogen from the outlet hole of the cooling apparatus whose concentration of solid nitrogen becomes low or null is increased in concentration of solid nitrogen with the apparatus for producing slush nitrogen and returned into the cooling apparatus so as to maintain a cooling capacity constant.

Further, according to the present invention, the apparatus for cooling the super conductive body further comprises a stirrer for stirring the slush nitrogen kept in the vessel.

Further, according to the present invention, an apparatus for cooling the super conductive body includes an adiabatic pipe configured for receiving the body, means for flowing slush nitrogen in the pipe, an inlet and an outlet for putting in and taking out the body in the pipe, and slush nitrogen at least enough to flow in the pipe. The body is put in the flowing slush nitrogen, and is in contact with the slush nitrogen.

The means for flowing slush nitrogen may be a means for forming a circulating flow wherein a liquid driving means such as a pump is connected between an upper stream end or an upper stream part of the pipe and a lower stream end or a lower stream part of the pipe. It is possible that a liquid driving means such as a pump is connected at an upper stream end or an upper stream part of the pipe, that slush nitrogen is delivered with pressure, and that slush nitrogen is drawn out from a downstream end or a downstream part so that slush nitrogen is flowed in the pipe. As for a liquid driving means of the latter case, it may be means for flowing with gravity from a tank disposed at higher position than the pipe.

Further, in case of a configuration of forming a circulating flow, an introducing port capable of introducing new slush nitrogen of high solid concentration is provided somewhere in the circulating path and a discharging port of slush nitrogen having a low concentration of solid nitrogen or liquid nitrogen is provided at another point more downstream than the introducing port of the circulating path, where introduction of new slush nitrogen is balanced with discharge of low concentrated slush nitrogen or liquid nitrogen so as to maintain cooling capacity constant.

Further, the cooling apparatus is connected to an apparatus for producing slush nitrogen. The drawn out slush nitrogen or liquid nitrogen from the discharging port of the cooling apparatus whose concentration of solid nitrogen becomes low or null is increased in concentration of solid nitrogen with the apparatus for producing slush nitrogen and returned into the cooling apparatus through the introducing port so as to maintain a cooling capacity constant.

As described above, effects of the present invention are wrapped up as follows.

Since the invention using an ejector can manufacture solid nitrogen or slash nitrogen under atmospheric pressure or pressure a little higher than atmospheric pressure in a low-temperature container, it does not provide the possibility that air may mix from the exterior in a vessel during manufacture.

Moreover, since liquid nitrogen is cooled and solid nitrogen is generated while liquid nitrogen and cooling agent are violently mixed by an ejector, the solid nitrogen of fine and uniform particle diameter is generated.

Moreover, a particle diameter of the solid nitrogen generated is variable by varying a supply pressure and/or a diameter of a nozzle of cooling agent, which is a driving fluid for ejector.

Furthermore, by heating the diffuser part of an ejector, frozen solid nitrogen is prevented to stick to the diffuser part to narrow a passage of the diffuser and occlude it.

The solid nitrogen produced can be made to be fine particles by disposing two ejectors face to face and by subjecting jet streams from the diffusers of the ejectors to collision with each other.

Further, freezing of the surface by contacting a cooling agent can be prevented by stirring the surface of liquid nitrogen.

Furthermore, effects of the present invention related to production of slush nitrogen and evaluation of solid nitrogen in slush nitrogen are wrapped up as follows.

According to the aforementioned present invention, because a cooling agent other than nitrogen is not used, there is no need to install a big apparatus such as an apparatus for recompressing the cooling agent. Thus, slush nitrogen stronger than liquid nitrogen as a cold heat source can be produced without such a big apparatus.

According to the aforementioned present invention, a concentration of solid nitrogen can be evaluated without a special apparatus.

Furthermore, effects of the present invention related to cooling by slush nitrogen are wrapped up as follows.

According to the aforementioned present invention, a cooling temperature can be lowered to a freezing point of nitrogen (63 K) using slush nitrogen. Therefore, despite inexpensiveness compared with liquid helium, a selection range for super conductive material is broadened or a super conductive action can be kept stable.

Further, as slush nitrogen is used as a state of slurry, the slurry-like cooling agent can flow into narrow parts and wet well the surface of the cooled body, which results in good heat conductive characteristics.

Further, since a latent heat of melting of solid nitrogen is utilized using slush nitrogen, there is a cooling effect 12.5 times as much as the case of sensible heat of liquid nitrogen per unit mass of a cooling agent. Therefore, less cooling agent than in case of cooling with liquid nitrogen is necessary so that an apparatus can be made smaller.

DESCRIPTION OF THE PREFERRED EMBODIMENT

The invention will now be described in detail by way of example with reference to the accompanying drawings. It should be understood, however, that the description herein of specific embodiments such as to the dimensions, the kinds of material, the configurations and the relative disposals of the elemental parts and the like is not intended to limit the invention to the particular forms disclosed but the intention is to disclose for the sake of example unless otherwise specifically described.

First Embodiment

Figure 1:
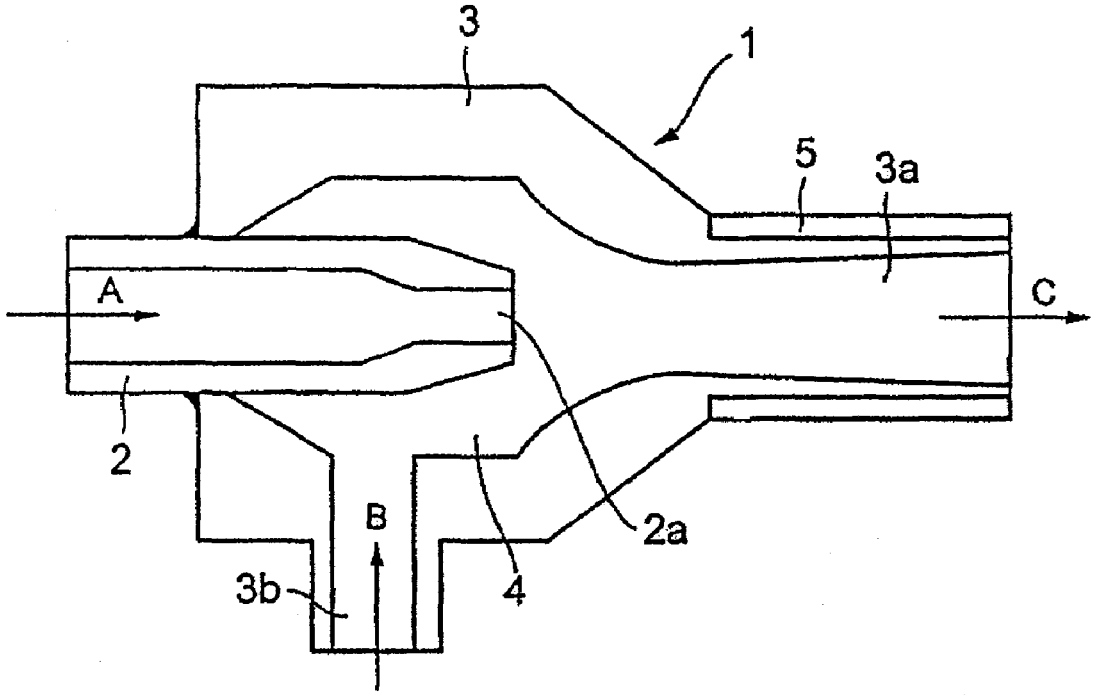
FIG. 1 is a sectional view of an ejector disposed in a low temperature vessel.

FIG. 1 is a sectional view of an ejector disposed in a low temperature vessel. As shown in FIG. 1, an ejector 1 comprises a nozzle 2 and an outer cylinder 3 having a diffuser part 3*a*. The nozzle 2 is protruded into the inner space 4 of the outer cylinder 3. A cooling agent of liquid or gas is supplied as shown as an arrow A and blown out of a nozzle end 2*a* toward the diffuser part 3*a*. Liquid nitrogen filled in a low temperature vessel is sucked into the inner space 4 from a suction hole 3*b* of the outer cylinder 3 as shown as an arrow B and blown into an inner space of the low temperature vessel together with a cooling agent flow through the diffuser part 3*a*. A heater 5 is provided at the outside of the diffuser part 3*a* in order to prevent for solid nitrogen to be frozen and fixed thereto.

Figure 2:
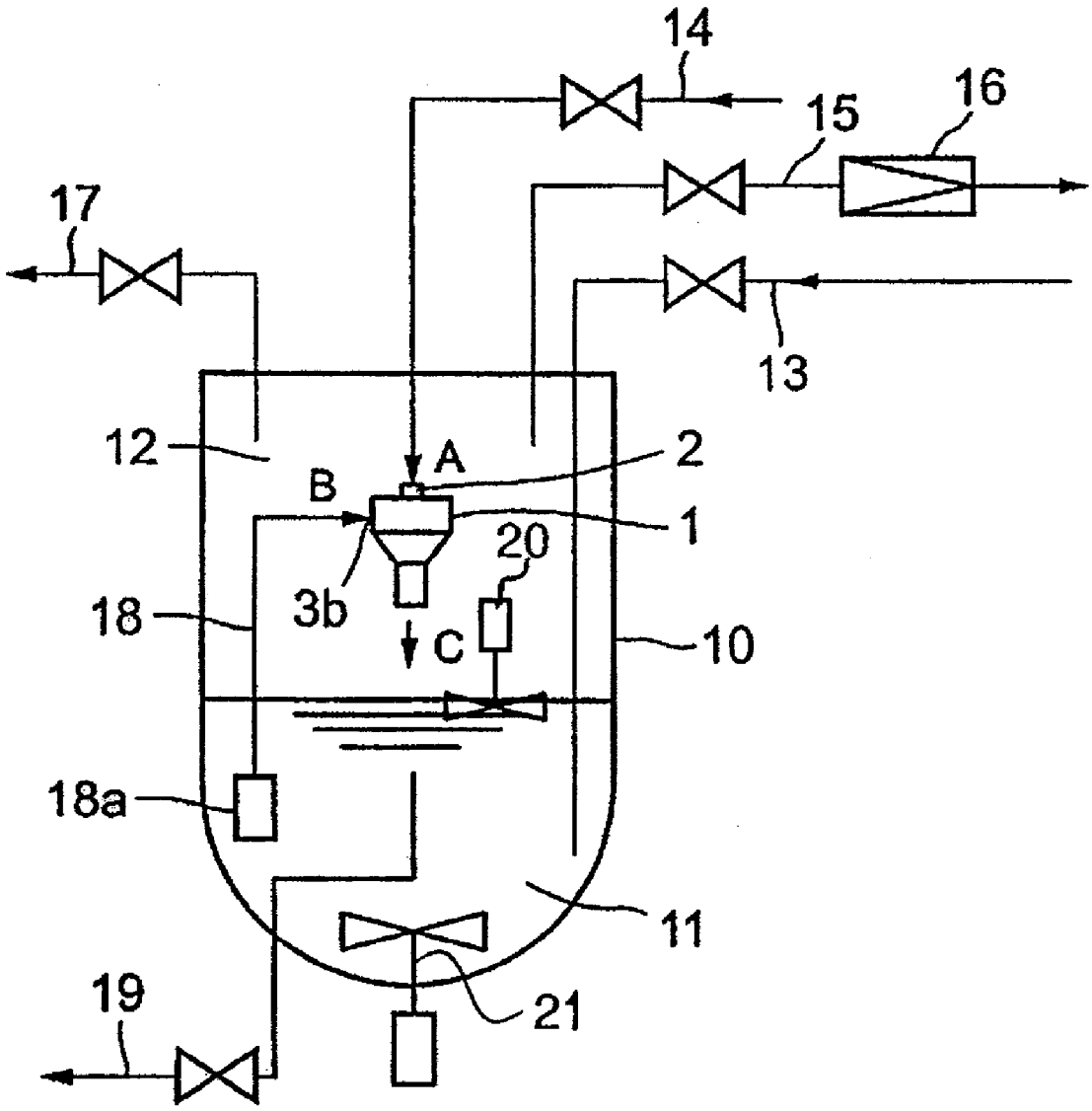
FIG. 2 is a drawing showing a piping of a low temperature vessel provided with an ejector.
Figure 3:
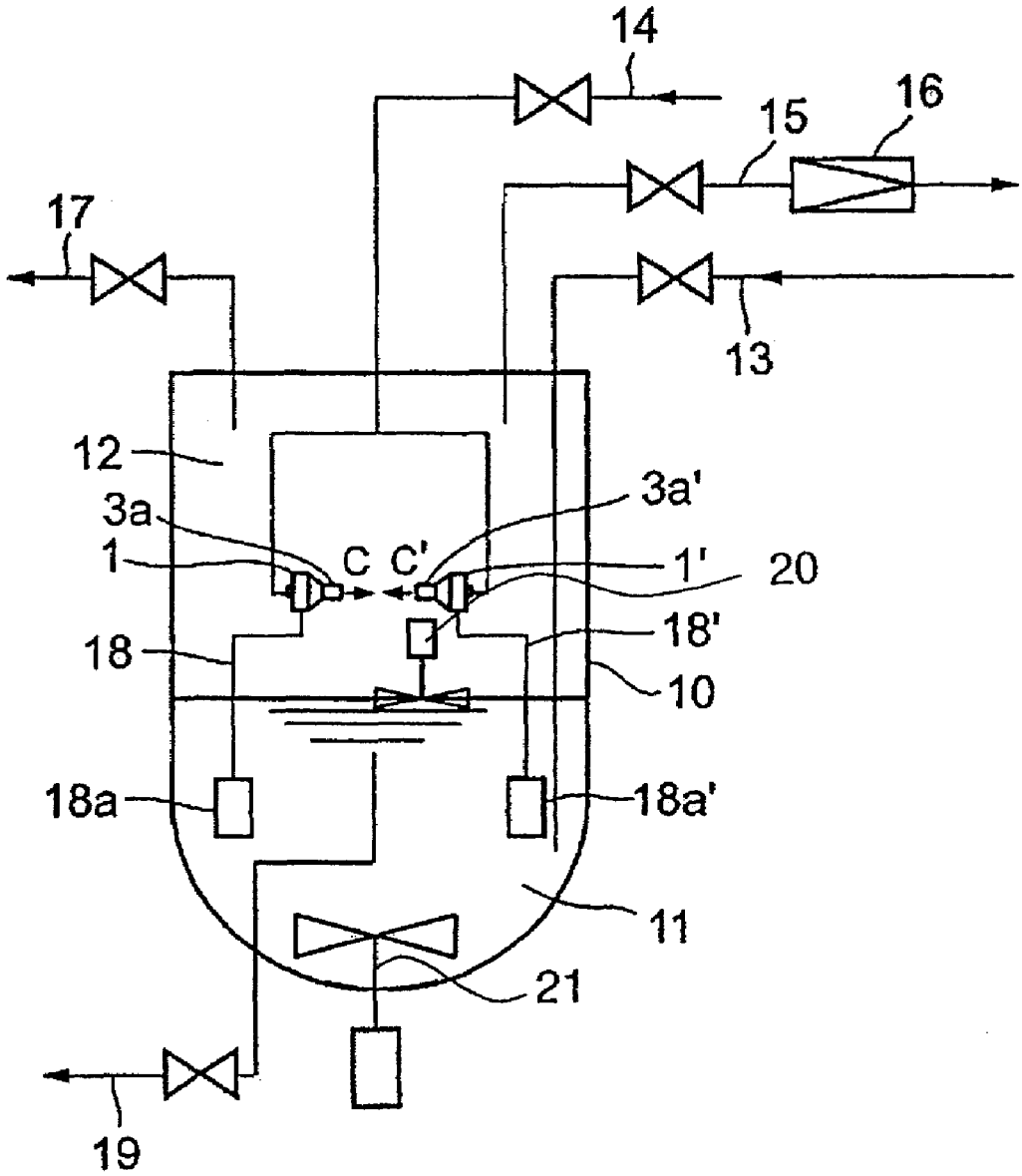
FIG. 3 is a drawing showing a case in which two ejectors are disposed face to face.
Figure 4:
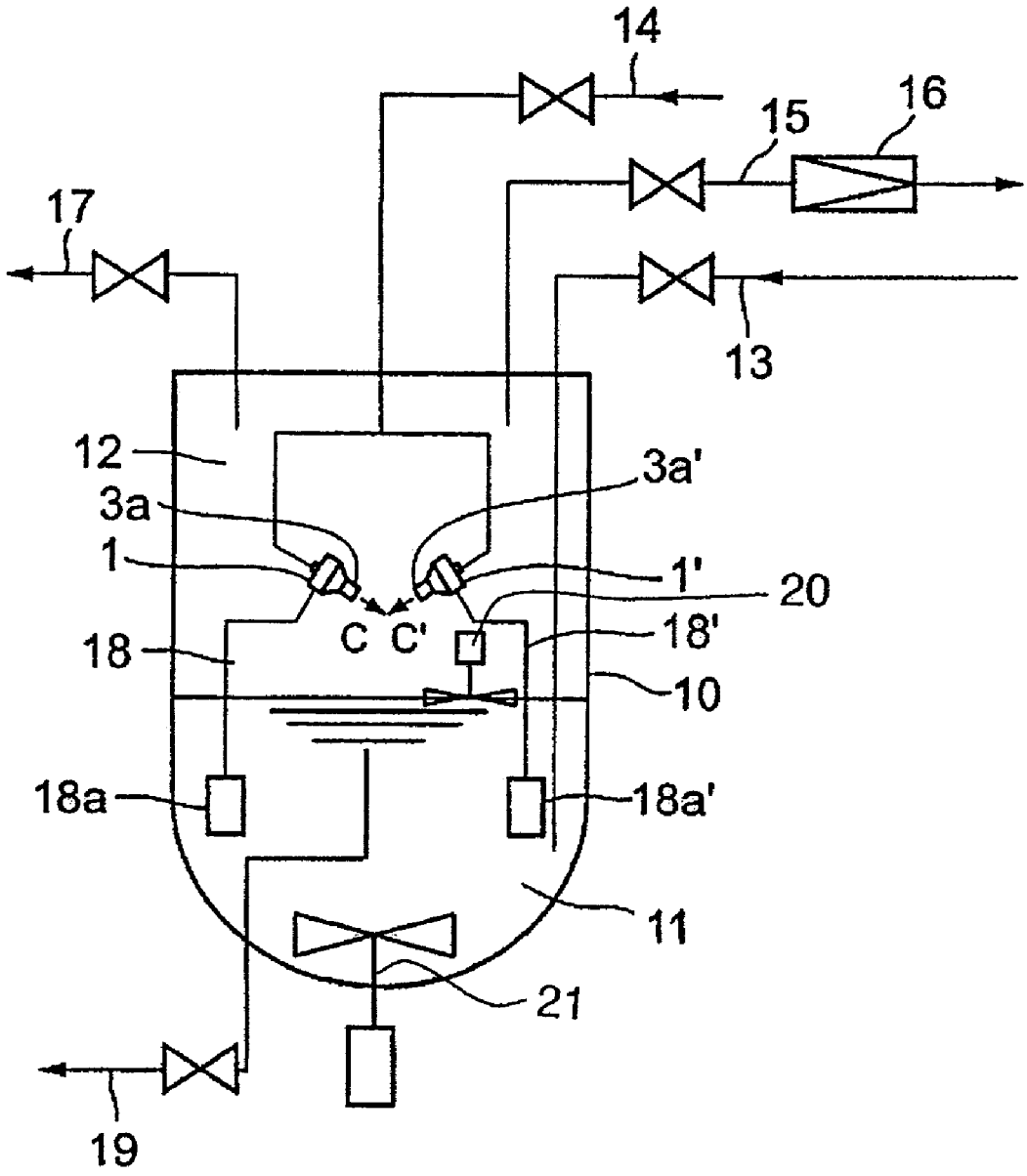
FIG. 4 is a drawing showing a case in which nozzles of the tow ejectors shown in FIG. 3 are disposed as slanted to the downward.

FIG. 2 is a drawing showing a piping of a low temperature vessel provided with an ejector. FIG. 3 is a drawing showing a case in which two ejectors are disposed face to face. FIG. 4 is a drawing showing a case in which nozzles of the two ejectors shown in FIG. 3 are disposed as slanted to the downward. In FIG. 2-4, the same references denote the same members.

In FIG. 2, liquid nitrogen 11 is filled in a low temperature vessel 10. The liquid nitrogen 11 is supplied from a liquid nitrogen supplying line 13 having a valve. A cooling agent such as liquid helium or low temperature helium gas is supplied to the nozzle 2 of the ejector 1 disposed in the low temperature vessel 10 through an ejector working fluid supplying line 14 having a valve. As a cooling agent, neon or hydrogen in addition to helium can be used. An evacuating line 15 having a vacuum pump 16 and a valve and an evacuating line 17 having a valve for maintaining slightly higher pressure than the atmospheric pressure are attached. A lower part of a liquid nitrogen suction pipe 18 connected to the suction hole 3*b* of the ejector 1 is immersed in the liquid nitrogen.

When liquid nitrogen is filled in the low temperature vessel and the vessel is closed and depressurized through the evacuating line 15 having a vacuum pump 16 and a valve, liquid nitrogen is evaporated and a temperature of the liquid nitrogen is lowered due to a latent heat of vaporization. When a temperature of the liquid nitrogen becomes a melting point at the atmospheric pressure, that is about 65 K which is slightly higher than solidifying temperature, liquid helium or low temperature helium gas is supplied to increase the inner pressure of the vessel to the atmospheric pressure or slightly higher than that. Supply of a cooling agent can be done through the ejector working fluid supplying line 14 and the ejector 1. When a cooling agent is continuously supplied to the ejector 1 with a higher pressure than the pressure in the vessel, the liquid nitrogen 11 is sucked to the suction hole 3*b* of the ejector 1 through the suction pipe 18 by a jet flow of the cooling agent blown out of a nozzle end 2*a* of the nozzle 2 and blown into the space 12 through the diffuser part 3*a* together with the cooling agent. The liquid nitrogen collides intensely and mixes with the cooling agent at the diffuser part 3*a* after going out from diffuser part to be cooled and become fine particles of solid nitrogen having comparatively even diameters. The solid nitrogen has a specific gravity far greater than that of the cooling agent gas filled in the space 12 so that it falls downward by gravitation. The supply of the cooling agent as a working fluid produces the increased amount of cooling agent gas in the vessel, resulting in the high pressure within the vessel. Therefore, the gas in the space 12 is constantly discharged from the evacuating line 17 in order to maintain the pressure in the space 21 slightly higher than the atmospheric pressure.

When a cooling agent of low temperature touches the upper surface of the liquid nitrogen 11, the surface of liquid freezes so that the solid nitrogen might not mix with the liquid nitrogen below. Consequently, a motor for stirring 20 is disposed in the vicinity of the liquid surface of the liquid nitrogen 11 so that the liquid surface is prevented to freeze by agitating the liquid surface. A motor for stirring 21 disposed at an underneath part in the liquid nitrogen 11 is for mixing liquid and solid nitrogen and for transforming into slush.

Alternatively, after the vessel is evacuated to vacuum through the evacuating line 15 having a vacuum pump 16 and a valve, a cooling agent such as liquid helium or low temperature helium gas is filled through the ejector working fluid supplying line 14 and liquid nitrogen is filled through a liquid nitrogen supplying line 13. Liquid nitrogen is filled so that a pressure in the vessel is equal to the atmospheric pressure or slightly higher than the atmospheric pressure. A cooling agent such as liquid helium is instantly vaporized to occupy the space 12 and liquid nitrogen is accumulated in the lower part of the low temperature vessel 10. Then, a cooling agent is supplied to the nozzle 2 of the ejector 1 with a pressure higher than the pressure in the vessel 10 through the ejector working fluid supplying line 14 similarly to the above.

A temperature of the liquid nitrogen in the vessel 10 is higher than that of the gas in the space 12. Nitrogen is partially vaporized from the surface of the liquid nitrogen 11 and gas in the space 12 becomes a mixture of a cooling agent gas and nitrogen. The gas discharged from the evacuating line 17 can be reused by separating into a cooling agent gas and nitrogen. Continuing the operation, slush nitrogen of a mixture of liquid and solid nitrogen is accumulated in the lower part of the vessel 10 and finally only solid nitrogen is accumulated. At an appropriate time, the slush nitrogen is discharged through a discharging line with a valve 19. Slush nitrogen can be continuously produced by balancing a supplying amount of liquid nitrogen and a generating amount of solid nitrogen. A strainer 18*a* is provided at the lower end of the suction pipe 18 for preventing a suction of solid nitrogen. Though one ejector is provided as shown in FIG. 2, a plurality of ejectors may be provided as a matter of cause.

FIG. 3 shows a case of tow ejectors 1 and 1' disposed face to face in the low temperature vessel 10. A cooling agent, which is a working gas, is supplied to the ejectors 1 and 1' by being branched at the down stream of the ejector working fluid supplying line 14. Strainers 18*a* and 18*a'* are provided at the lower ends of the suction pipes 18 and 18', and immersed into the liquid nitrogen 11.

Diffuser parts 3*a*, 3*a'* of the both ejectors are disposed face to face so that generated solid nitrogen is finely pulverized by two jet streams C,C' colliding each other. Other actions are similar to the case shown in FIG. 2.

FIG. 4 is a drawing showing a case in which the two ejectors 1, 1' shown in FIG. 3 are disposed as slanted to the downward. Thus, the generated solid nitrogen is easy to drop downward.

As described above, though a case of producing slush nitrogen is explained according to the present invention, the above method can be also applied to production of slush hydrogen.

Second Embodiment

Figure 5:
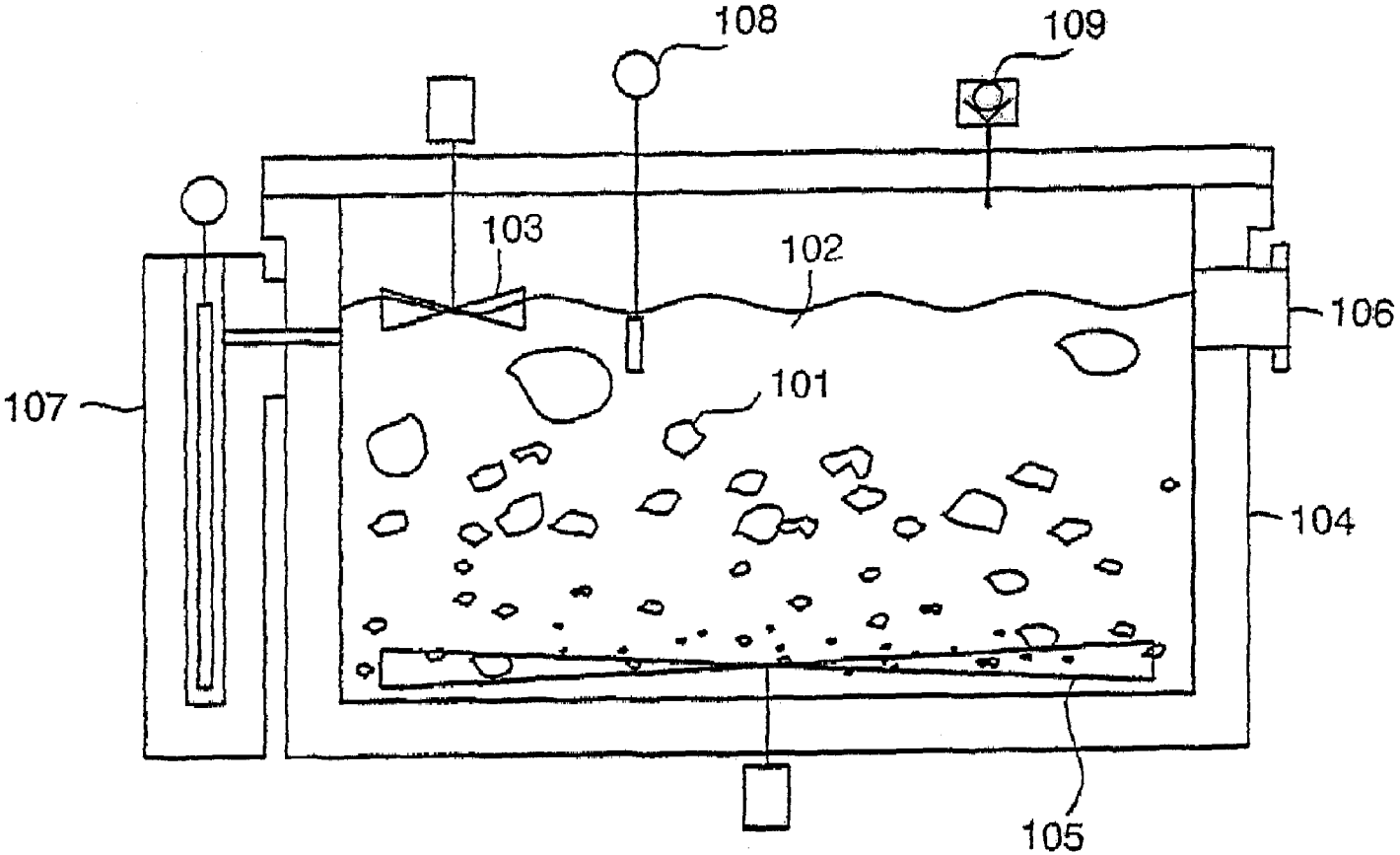
FIG. 5 is a schematic illustration of an apparatus of a second embodiment according to the present invention.

FIG. 5 is a schematic illustration of an apparatus of a second embodiment according to the present invention. In FIG. 5, 104 is an adiabatic vessel; 102 is liquid nitrogen held in the vessel; 109 is a vacuum pump for depressurizing a gaseous part (a means for depressurizing); 108 is a thermometer detectable of the triple point (a means for detecting temperature); 107 is a level gauge capable of finding a present value of the volume; 103 is a stirring blade for surface part capable of breaking a plate of solid nitrogen solidified on the surface (a means for stirring a part of liquid surface); 105 is a stirring blade for bottom part capable of further pulverizing sedimented solid nitrogen (a means for stirring a bottom part).

Liquid nitrogen 102 is stored in the adiabatic vessel 104 and a gaseous phase of the inner part of the vessel is depressurized with a vacuum pump 109. When depressurization proceeds, liquid nitrogen is evaporated and a temperature of liquid nitrogen is gradually lowered by the latent heat of vaporization.

When the content reaches a triple point of nitrogen by continuing to depressurize, solid nitrogen begins to be generated. Arrival at a triple point is confirmed by observing the inner part from a window 106 or by the fact that a temperature does not become lower than 63.1 K with a thermometer 108. When reaching a triple point of nitrogen, the vacuum pump 109 is stopped and a level is measured with the level gauge 107. After that, the vacuum pump 109 is activated and the both stirring blades 103, 105 are rotated.

By depressurizing, solid nitrogen is thinly generated over the whole surface of liquid nitrogen. If it is left as it is, the solid nitrogen is sucked upward toward the suction hole of the vacuum pump 109 to depart from the liquid and the next solid nitrogen is generated in that space. The stirring blade 103 is provided in the vicinity of the liquid surface. The liquid surface is agitated by operation thereof and the generated solid nitrogen 101 is sedimented in the liquid. As the solid nitrogen 101 is greater in density than liquid nitrogen, it sediments on the bottom as it is. The stirring blade 105 mixes the sedimenting solid nitrogen 101 and the liquid nitrogen 102 so as to obtain slurry like slush nitrogen.

Third Embodiment

Next, an embodiment of evaluating slush nitrogen concentration is described. Let a latent heat of vaporization of nitrogen, a latent heat of solidification, a density of liquid nitrogen, a density of solid nitrogen, a volume of nitrogen at triple point, a volume of nitrogen after production of slush nitrogen, a liquid nitrogen corresponding value of a volume of vaporized nitrogen, a volume of vaporized solid nitrogen, a heat intruded into the adiabatic vessel, and a time consumed for production of slush nitrogen be $H_v$ (kJ/kg), $H_s$ (kJ/kg), $M_l$ (kg/m$^3$), $M_s$ (kg/m$^3$), $V_s$ (m$^3$), $V_f$ (m$^3$), $X_v$ (m$^3$), $X_s$ (m$^3$), Q (kW), and T (s) respectively, from energy conservation law, $$H_v \times M_l \times X_v = H_s \times M_s \times X_s + Q \times T \quad (1)$$

from law of conservation of mass, $$V_s \times M_l = (V_f - X_s) \times M_l + X_s \times M_s + X_v \times M_l \quad (2).$$

Xv and Xs are found from the above simultaneous equations and the obtained values are substituted into the following equation to find a slush nitrogen concentration (IPF).

$$IPF = X_s \times M_s / ((V_f - X_s) \times M_l + X_s \times M_s)$$

A heat intruded into the adiabatic vessel Q can be found by measuring a heat of vaporization of liquid nitrogen in advance. However, it can be omitted because it accounts only small fraction of vaporized nitrogen.

Fourth Embodiment

Figure 6:
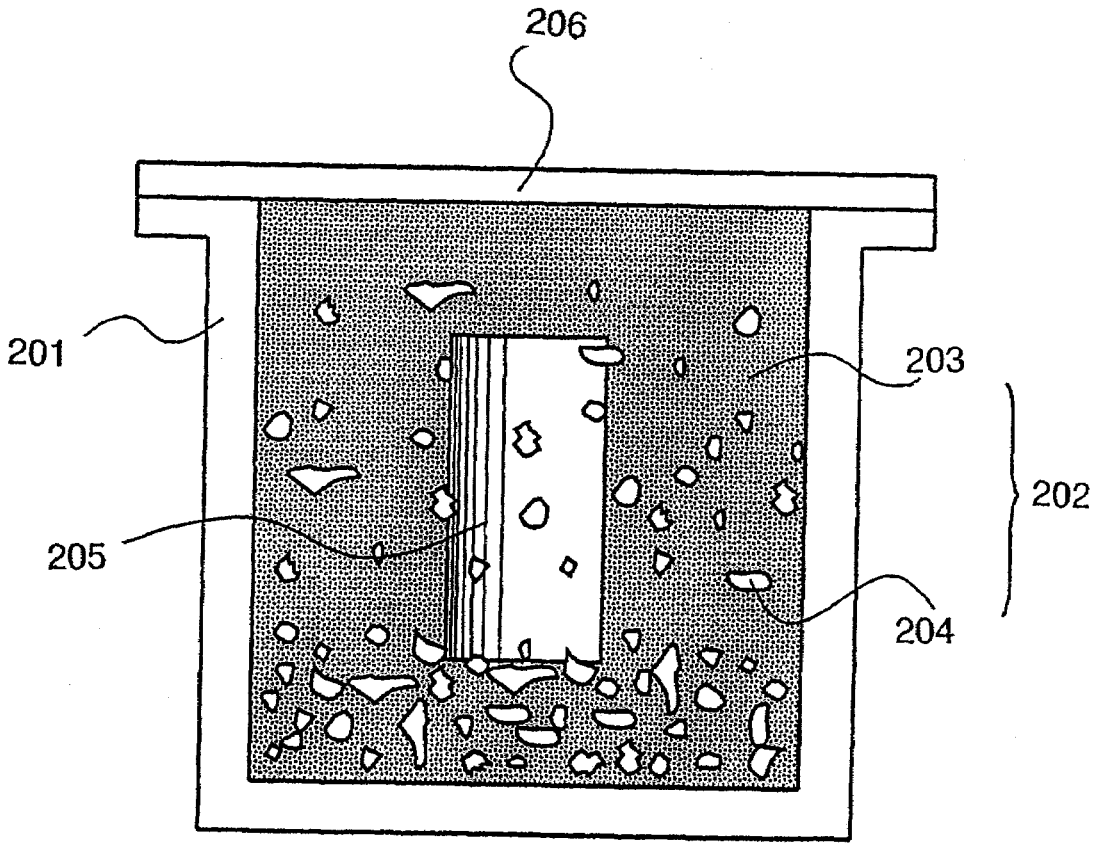
FIG. 6 is a schematic illustration of an apparatus of a forth embodiment according to the present invention.

FIG. 6 is a schematic illustration of an apparatus of a forth embodiment according to the present invention. In FIG. 6, 201 is an adiabatic vessel; 204 is fine particles of solid nitrogen; 203 is liquid nitrogen; 202 is slush nitrogen which is a mixed slurry of 204 and 203; 205 is a super conductive body; and 206 is an inlet and outlet port provided on the vessel.

A super conductive coil (a super conductive body 205) is put into the adiabatic vessel 201 through the inlet and outlet port 206. After slush nitrogen is filled. The inlet and outlet port 206 is shut. The coil is cooled to keep below a super conductive critical temperature.

Fifth Embodiment

Figure 7:
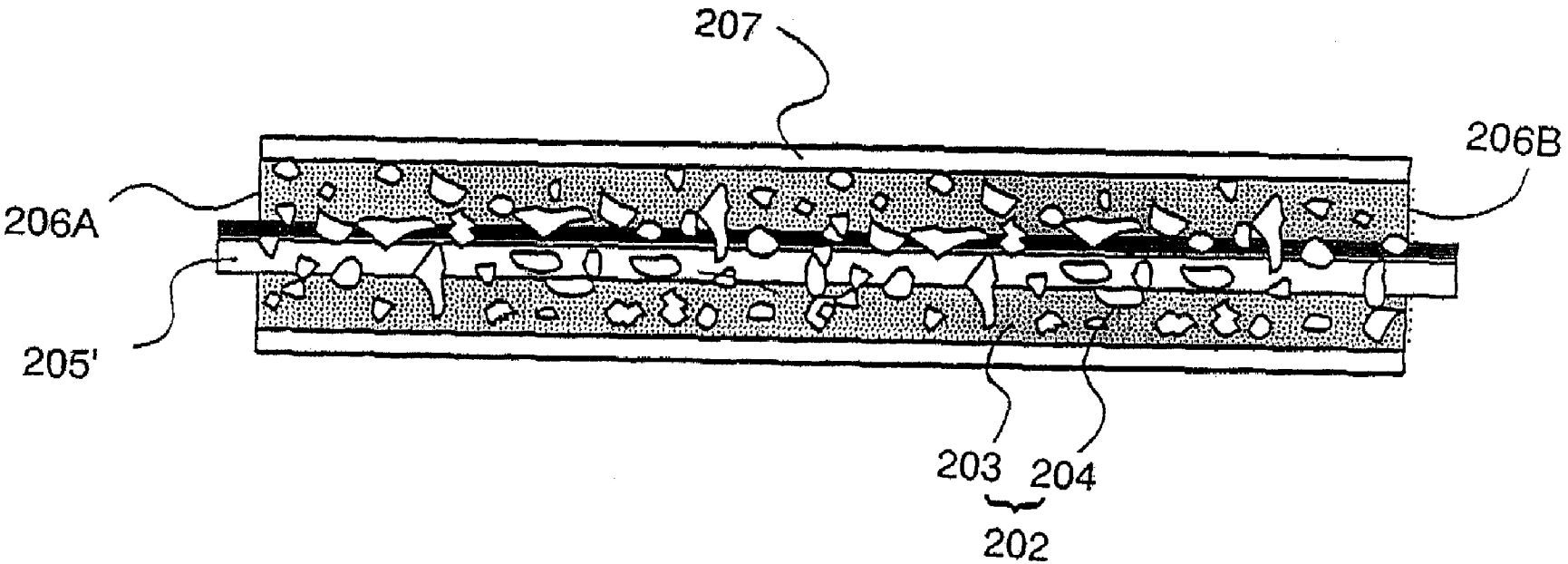
FIG. 7 is a schematic illustration of an apparatus of a fifth embodiment according to the present invention.

FIG. 7 is a schematic illustration of an apparatus of a fifth embodiment according to the present invention. In FIG. 7, 207 is an adiabatic pipe; 204 are fine particles of solid nitrogen; 203 is liquid nitrogen; 202 is slush nitrogen which is mixed slurry of 204 and 203; 205' is a super conductive body; and 206A and 206B are inlet and outlet ports provided on the pipe.

A long-sized super conductive cable 205' is inserted in the adiabatic pipe 207 through the input and output port 206A. Slush nitrogen 202 is delivered with pressure through an introducing port (not shown in the figure) by an means for flowing (not shown in the figure) and discharged through an discharging port (not shown in the figure), whereby slush nitrogen is flowed in the pipe so that the super conductive cable is cooled, and kept below a super conductive critical temperature.

INDUSTRIAL APPLICABILITY

Slush nitrogen produced according to the present invention can be utilized as a cold heat in various industries. The slush nitrogen has excellent utilities such as portability, convenience, and low-temperature property so that increasing needs in future can be expected.

Further, since a cooling technique according to the present invention is a method, which have a good volumetric efficiency, capable of cooling at a temperature lower than that of liquid nitrogen, a low temperature can be maintained with a small cooling apparatus. Therefore, the method is appropriate for cooling a high-temperature super conductive body so that it can contribute to the practical application of a super conductive technology.

What is claimed is:

1. A method of cooling a super conductive body comprising the steps of:

depressurizing a gaseous phase of liquid nitrogen contained in an adiabatic vessel to vaporize the nitrogen in a liquid phase to lower the temperature of the nitrogen to or below the triple point of nitrogen;

withdrawing the liquid nitrogen in the vessel with an ejector disposed in a portion of the adiabatic vessel where the gaseous phase of nitrogen exists;

colliding and mixing the withdrawn liquid nitrogen with a cooling agent sprayed at a high pressure to produce solid nitrogen at the triple point;

transforming the produced solid nitrogen into slush nitrogen in the adiabatic vessel;

providing a super conductive body formed of a material that exhibits a state of super conductance in the vicinity of the temperature of liquid nitrogen or of the temperature where liquid nitrogen and solid nitrogen coexist; and contacting the super conductive body with the slush nitrogen to cool the super conductive body.

2. The method according to claim 1, further including the step of introducing the slush nitrogen from the adiabatic vessel to another adiabatic vessel and wherein the contacting step comprises immersing the superconductive body in the slush nitrogen contained in the another adiabatic vessel.

3. The method according to claim 2, further comprising the step of stirring the slush nitrogen in the adiabatic vessel while the super conductive body is immersed in the slush nitrogen.

4. The method according to claim 1, wherein the contacting step includes flowing the slush nitrogen from the adiabatic vessel in an adiabatic pipe while the super conductive body is placed in the adiabatic pipe.

5. The method according to claim 2, wherein the another adiabatic vessel has an inlet and outlet port for receiving the super conductive body and for removing the super conductive body.

6. The method according to claim 5, further including a stirrer for stirring the slush nitrogen in the adiabatic vessel where the slush nitrogen is produced.

7. An apparatus for cooling a super conductive body formed of a material that exhibits a state of super conductance in the vicinity of the temperature of liquid nitrogen or of the temperature where liquid nitrogen and solid nitrogen coexist, the apparatus comprising:

a slush nitrogen producing device having an adiabatic vessel and an ejector, wherein the slush nitrogen producing device depressurizes a gaseous phase of liquid nitrogen contained in the adiabatic vessel to vaporize the nitrogen in a liquid phase to lower the temperature of the nitrogen to or below the triple point of nitrogen, withdraws the liquid nitrogen in the vessel with the ejector disposed in a portion of the adiabatic vessel where the gaseous phase of nitrogen exists, collides and mixes the withdrawn liquid nitrogen with a cooling agent sprayed at a high pressure to produce solid nitrogen at the triple point, and transforms the produced solid nitrogen into slush nitrogen in the adiabatic vessel;

an adiabatic pipe sized to allow insertion of the super conductive body; and means for flowing the slush nitrogen from the adiabatic vessel of the slush nitrogen producing device through the pipe, wherein the pipe has an inlet for insertion of the super conductive body and an outlet for taking out the super conductive body from the pipe, and wherein the super conductive body is placeable in the pipe so that the flowing slush nitrogen cools the super conductive body.

8. An apparatus for cooling a super conductive body formed of a material that exhibits a state of super conductance in the vicinity of the temperature of liquid nitrogen or of the temperature where liquid nitrogen and solid nitrogen coexist, the apparatus comprising:

a slush nitrogen producing device having an adiabatic vessel and an ejector, wherein the slush nitrogen producing device depressurizes a gaseous phase of liquid nitrogen contained in the adiabatic vessel to vaporize the nitrogen in a liquid phase to lower the temperature of the nitrogen to or below the triple point of nitrogen, withdraws the liquid nitrogen in the vessel with the ejector disposed in a portion of the adiabatic vessel where the gaseous phase of nitrogen exists, collides and mixes the withdrawn liquid nitrogen with a cooling agent sprayed at a high pressure to produce solid nitrogen at the triple point, and transforms the produced solid nitrogen into slush nitrogen in the adiabatic vessel; and another adiabatic vessel for holding the slush nitrogen from the slush nitrogen producing device and being sized to receive the super conductive body therein, wherein the another adiabatic vessel has an inlet and outlet port for inserting the super conductive body and for removing the super conductive body, and wherein the super conductive body is immersible in the another adiabatic vessel so that the slush nitrogen contacts and cools the super conductive body.

9. The apparatus according to claim 8, further including a stirrer for stirring the slush nitrogen in the adiabatic vessel.

* * * * *

UNITED STATES PATENT AND TRADEMARK OFFICE

CERTIFICATE OF CORRECTION

PATENT NO. : 7,370,481 B2
APPLICATION NO. : 11/532527
DATED : May 13, 2008
INVENTOR(S) : Kuniaki Kawamura et al.

It is certified that error appears in the above-identified patent and that said Letters Patent is hereby corrected as shown below:

On title page in Item (56), References Cited, please insert the following U.S. Patent Documents:

--3,521,458 A 7/21/1970 Huibers et al.--
--3,354,662 A 11/28/1967 Daunt--

Signed and Sealed this

Fifth Day of August, 2008

JON W. DUDAS
*Director of the United States Patent and Trademark Office*